US008258855B2

(12) United States Patent
Come et al.

(10) Patent No.: US 8,258,855 B2
(45) Date of Patent: Sep. 4, 2012

(54) METHOD FOR CONTROLLING A SERVO SYSTEM

(75) Inventors: Sylvain Come, Pezou (FR); Thierry Ginestet, Vendome (FR); David Chaillou, Aze (FR)

(73) Assignee: Thales, Neuilly sur Seine (FR)

( * ) Notice: Subject to any disclaimer, the term of this patent is extended or adjusted under 35 U.S.C. 154(b) by 0 days.

(21) Appl. No.: 12/681,597

(22) PCT Filed: Oct. 1, 2008

(86) PCT No.: PCT/EP2008/063119

§ 371 (c)(1),
(2), (4) Date: Nov. 16, 2010

(87) PCT Pub. No.: WO2009/043863

PCT Pub. Date: Apr. 9, 2009

(65) Prior Publication Data

US 2011/0050147 A1 Mar. 3, 2011

(30) Foreign Application Priority Data

Oct. 2, 2007 (FR) ..... 07 06900

(51) Int. Cl.
*G05F 1/00* (2006.01)

(52) U.S. Cl. ..... 327/518; 327/514

(58) Field of Classification Search ..... None
See application file for complete search history.

(56) References Cited

U.S. PATENT DOCUMENTS 7,755,349 B2 * 7/2010 James ..... 324/207.13

FOREIGN PATENT DOCUMENTS

| | | | |
|---|---|---|---|
| WO | 02/47438 | A2 | 6/2002 |
| WO | 2006/011108 | A1 | 2/2006 |
| WO | 2006/111689 | A1 | 10/2006 |
| WO | 2006/126151 | A2 | 11/2006 |

* cited by examiner

*Primary Examiner* — Cassandra Cox
(74) *Attorney, Agent, or Firm* — Baker & Hostetler LLP

(57) ABSTRACT

The invention relates to a method for commanding a system controlled by means of a time-division multi-level command. The invention consists in acquiring two measurements by means of the sensor, each during a period, the two periods being dissymmetrical relative to the division of the command, determining an offset of the control subsystem and a corrected response without offset of the system to the command as a function of the measurements and of the measurement periods. With the aid of these two measurements, the invention makes it possible to eliminate the effect of the offset in the control subsystem of the system.

9 Claims, 2 Drawing Sheets

METHOD FOR CONTROLLING A SERVO SYSTEM

CROSS-REFERENCE TO RELATED APPLICATIONS

This application is a National Stage of International patent application PCT/EP2008/063119, filed on Oct. 1, 2008, which claims priority to foreign French patent application No. FR 07 06900, filed on Oct. 2, 2007, the disclosures of which are hereby incorporated by reference in their entirety.

FIELD OF THE INVENTION

The invention relates to a method for commanding a controlled system. This method is also called servo control or closed-loop control. In a servo control, a command device comprises a control subsystem comprising a sensor measuring a characteristic variable of the system evolving as a function of a setpoint and a comparator measuring a difference between the setpoint and the value of the variable. The sensor is also called a control sensor. The system is commanded by the difference measured by the comparator.

BACKGROUND OF THE INVENTION

In a servo control, the accuracy of the response of the system to an evolution of the setpoint is usually good. Specifically, the control tends to cancel out the difference between the setpoint and the value of the characteristic variable of the system monitored by the control sensor.

Nevertheless, the control subsystem may sustain an offset, tending to define a non-zero error even if the response of the system is perfectly suited to the setpoint. The offset may be due to the accuracy of the components of the control subsystem. The offset may evolve over time as a function of distinct parameters of the setpoint influencing the response of the system, parameters such as for example the evolution of the ambient temperature or else the wear of the components of the control subsystem.

The problem is currently solved by acting on each of the offsets of the various components and by trying to minimize their value by optimizing the design. Although costly because of the optimization necessary, this solution may be satisfactory at a given time, but does not prevent the evolution of the offset over time.

The invention can be applied in a backlighting command of liquid crystal screens used on aircraft instrument panels where it is necessary for the pilot of the aircraft to be able to see these screens irrespective of the ambient light in the cockpit.

In addition to the electronic offsets specific to any measurement subsystem, the preponderant offset for this backlighting application is generated by the ambient lighting in the cockpit, notably when the sun lights up the liquid crystal screen. A sufficient fraction of ambient light is then measured by the internal lighting sensor and skews the measurement of the latter. Since this interference lighting is added to that generated from the backlighting light source, the accuracy of the brightness seen by the pilot is degraded.

SUMMARY OF THE INVENTION

An object of the invention is to improve the robustness of the command of a controlled system by no longer seeking to minimize the offset but by measuring it in order to be able to compensate for it.

The invention is suitable for a system controlled by means of a time-division multi-level command. Specifically, it will take advantage of the various command levels of the system to allow the offset to be measured.

Accordingly, the subject of the invention is a method for commanding a system controlled by means of a time-division multi-level command, the method using a device receiving a setpoint and comprising a control subsystem in which a sensor measures a characteristic variable of the system which changes as a function of the setpoint, the measurement of the variable being capable of modifying the command of the system through the control subsystem, the method being characterized in that it comprises the following operations:

- acquiring two measurements by means of the sensor, each during a period, the two periods being dissymmetrical relative to the division of the command,
- determining an offset of the control subsystem and a corrected response without offset of the system to the command as a function of the measurements and of the measurement periods.

The measured offset can be calculated and subtracted from the measurements acquired by the control sensor by a system of two equations with two unknowns, the two unknowns being the response of the system and the offset of the measurement subsystem, the two equations being the measurements expressed as a function of the two unknowns. The two equations are not redundant if the two periods are dissymmetrical relative to the division of the command and therefore allow the resolution of the system of equations.

In a particular embodiment of the invention, the preponderant offset measured by the control sensor is caused by a physical phenomenon that it is worthwhile quantifying since its value, usually measured by an ancillary system, is used in the definition of the setpoint of the system.

For example, in a backlighting command of a liquid crystal screen, the evolution of the offset is mainly due to the variations in the ambient lighting, described above as being the physical phenomenon. By determining a response without offset of the system, the invention makes it possible to obtain a lighting measurement that is independent of the ambient light. The offset can also be used to adapt the setpoint 11 instead of the use of an ancillary sensor for measuring the ambient lighting. This makes it possible to use only a single sensor to both control the lighting command to the setpoint, and measure the ambient lighting in order to generate the setpoint. In other words, in a more general manner, the setpoint received by the device can be a function of the measured offset. In this instance, the measurement of the offset, mainly due to the ambient lighting, is weighted and then added to the setpoint. For example, the lighting setpoint is increased when the ambient light increases.

BRIEF DESCRIPTION OF THE DRAWINGS

The invention will be better understood and other advantages will appear on reading the detailed description of an embodiment given as an example, which description is illustrated by the appended drawing in which.

For the purposes of clarity, the same elements will bear the same references in the various figures.

DETAILED DESCRIPTION

Figure 1:
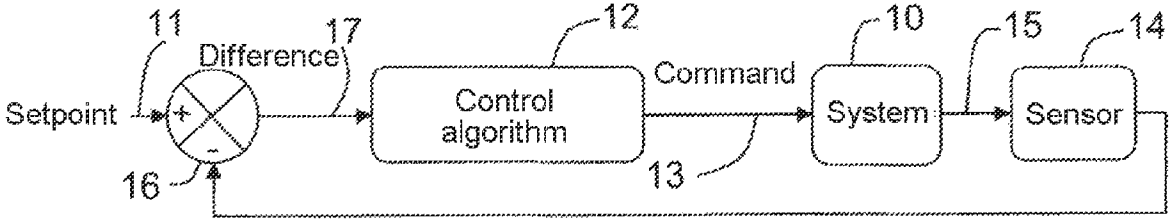
FIG. 1 represents in schematic form a controlled system for which the invention can be applied.

FIG. 1 represents an example of a device for commanding a system 10 as a function of a setpoint 11. The device comprises control means 12 delivering to the system 10 a command 13 through a control algorithm. The device also comprises a control sensor 14 measuring a characteristic variable 15 of the system 10 and evolving as a function of the command 13 and a comparator 16 measuring a difference 17 between the setpoint 11 and the value of the variable 15. The difference 17 forms the input datum of the control means 12.

A method according to the invention is adapted to a time-division multi-level command. This command is for example cyclical and inside a cycle there follows an active phase during which the system is commanded to a maximum level and an inactive phase during which the system is commanded to a minimum level, for example zero. This type of command is called command by pulse width modulation. The timing chart of FIG. 2*a*, marked PWM, represents the evolution over time of the command of the system 10. The command 13 evolves on two levels. A first low level bears the reference 20 and a second high level bears the reference 21. In the exemplary embodiment of the backlighting of a liquid crystal screen, the system 10 may comprise light-emitting diodes. The low level 20 corresponds to the diodes being switched off and the high level 21 corresponds to a full-power supply of the light-emitting diodes. An operating cycle 22 is defined between two rising edges 23 and 24 forming transitions from level 20 to level 21.

According to the invention, the method comprises the following operations:

- acquiring two measurements by means of the sensor 14, each during a period, the two periods being dissymmetrical relative to the division of the command,
- determining an offset of the control subsystem and a response of the system to the command 13 as a function of the measurements and of the measurement periods.

Figures 2A, 2B, 2C, 2D:
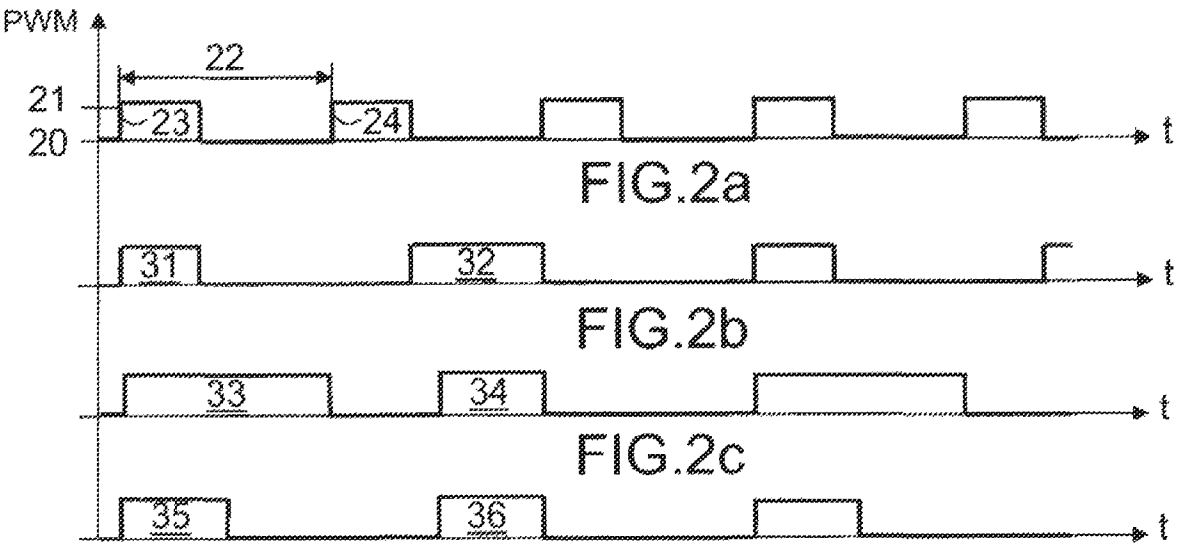
FIGS. 2*a* to 2*d* represent in the form of a timing chart a command of a system and several examples of measurements making it possible to determine the offset of the control subsystem.

The timing chart of FIG. 2*b* represents an exemplary embodiment of the two periods. The period of the first measurement 31 extends over the duration of the active phase and the period of the second measurement 32 extends over the duration of the inactive phase. In other words, the first measurement 31 is taken while the command 13 is at the high level 21 and the second measurement 32 is taken while the command 13 is at the low level 20. The synchronization of the two measurements 31 and 32 on the levels 20 and 21 can be carried out by the control means 12 which also determine the transitions between the levels 20 and 21.

In the example illustrated by the timing chart of FIG. 2*b*, the determination of the offset is made directly by the value measured by the sensor 14 during the measurement 32. The determination of the response of the system 10 to the command 13 is made by deducting the offset of the value measured by the sensor 14 during the measurement 31. This type of determination is simple to apply. Nevertheless, the duration of the measurements depends on the duty factor and may make the measurements inaccurate when the duty factor is close to 0% or close to 100%. Specifically in these two cases, one of the two measurements 31 or 32 is made for a much shorter period than the other and the shorter measurement is therefore more inaccurate than the other.

Two other exemplary embodiments of a method according to the invention are illustrated by the timing charts of FIGS. 2*c* and 2*d* and make it possible to improve the accuracy of the determination of the offset and of the response of the system by lengthening the measurement periods beyond a given value. For example, the measurement periods extend over at least half of the cycle 22.

In the example illustrated by the timing chart of FIG. 2*c*, the period of a first measurement 33 extends over a complete cycle and the period of a second measurement 34 extends over a final half-cycle.

The measurement 33 can be expressed as follows:

$$M_{long}=R_{system}+\text{Offset}_{cycle} \tag{1}$$

$M_{long}$ representing the measurement 33, $R_{system}$ representing the response of the system and $\text{Offset}_{cycle}$ representing the offset over a complete cycle.

The measurement 34 depends on the duty factor. If this factor is less than 50%, the measurement 33 can be expressed as follows:

$$M_{short}=\text{Offset}_{1/2\ cycle} \tag{2}$$

$M_{short}$ representing the measurement 34, and $\text{Offset}_{1/2\ cycle}$ representing the offset over half of the cycle. If the duty factor is greater than 50%, the measurement 33 can be expressed as follows:

$$M_{short}=R_{system}-\tfrac{1}{2}R_{system\ max}+\text{Offset}_{1/2\ cycle} \tag{3}$$

$R_{system\ max}$ representing the response of the system for a duty factor of 100%.

In both cases, duty factor being less than or greater than 50%, the response of the system $R_{system}$ can be expressed as a function of:

$$M_{long}-2\times M_{short} \tag{4}$$

Specifically, if the duty factor is less than 50%, this gives:

$$M_{long}-2\times M_{short}=(R_{system}+\text{Offset}_{cycle})-2\times\text{Offset}_{1/2\ cycle} \tag{5}$$

$$=R_{system} \tag{6}$$

considering that the offset is constant over the whole cycle and therefore that:

$$\text{Offset}_{cycle}=2\times\text{Offset}_{1/2\ cycle} \tag{7}$$

Moreover, if the duty factor is greater than 50%, this gives:

$$M_{long}-2\times M_{short}= \tag{8}$$

$$(R_{system}+\text{Offset}_{cycle})-2\times\left(R_{system}-\frac{1}{2}R_{system\ max}+\text{Offset}_{1/2\ cycle}\right)$$

and therefore:

$$M_{long}-2\times M_{short}=R_{system\ max}-R_{system} \tag{9}$$

The response of the system $R_{system\ max}$ for a duty factor of 100% being a constant known elsewhere, it is easy to determine the effective response of the system $R_{system}$. This response is not subjected to the offset.

Based on the response of the system, determined previously, it is easy to determine the offset if necessary from one of the two measurements 33 or 34. For example, from the measurement 33 the equation (1) is used:

$$\text{Offset}_{cycle}=M_{long}-R_{system} \tag{10}$$

The offset thus defined can be used to define the command 11 for example in the case of an embodiment of the invention for the backlighting of a screen considering that the preponderant offset is associated with the ambient light.

Figure 3:
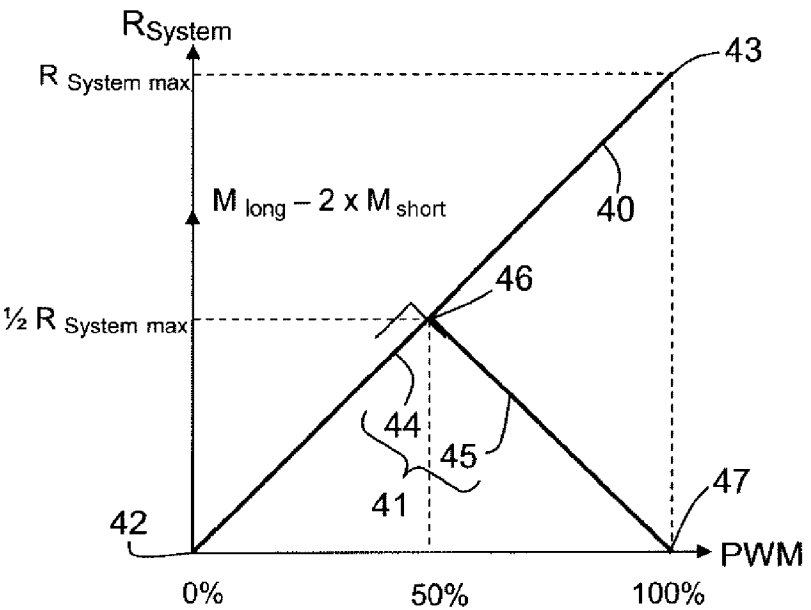
FIG. 3 represents an example of a measurement taken by a device according to the invention and making it possible to eliminate the effect of the offset.

FIG. 3 represents in a rectangular coordinate system two superposed curves 40 and 41. The curve 40, shown as a thin line, expresses the response of the system $R_{system}$ as a function of the duty factor marked PWM. The duty factor PWM evolves from 0% to 100%. The curve 40 is a line segment extending from an origin 42 of the coordinate system to a point 43 linking the maximum response of the system $R_{system\ max}$ to a duty factor of 100%.

The curve 41 represents in the same coordinate system the difference between the measurement 33, $M_{long}$, and twice the measurement 34, $M_{short}$, as a function of the duty factor PWM in the form of a curve 41 as a thick line. The curve 41 is formed of two line segments 44 and 45. The segment 44 extends from the origin 42 of the coordinate system to a point 46 linking half of the maximum response of the system, $\frac{1}{2} R_{system\ max}$, to a duty factor of 50%. The segment 44 is superposed on the curve 40. The segment 45 extends from the point 46 to a point 47 linking a difference between the measurement 33, M long, and twice the measurement 34, $M_{short}$, zero to a duty factor of 100%.

In the example illustrated by the timing chart of FIG. 2*d*, the period of a first measurement 35 extends over an initial half-cycle and a second measurement 36 extends over a final half-cycle. A calculation mode similar to the previous one can be applied in order to determine the offset and the response of the system while eliminating the effect of the offset.

Figure 4:
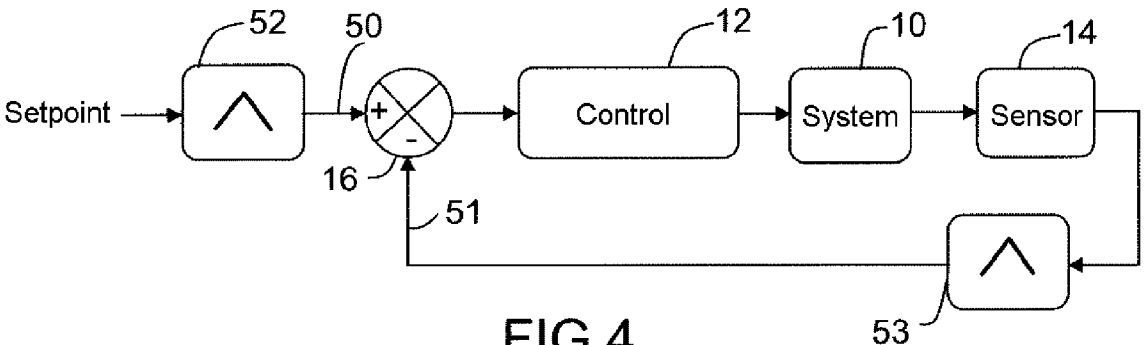
FIG. 4 represents an example of a control subsystem using the invention.

FIG. 4 represents an example of a control subsystem adapted to the measurements 33 and 34 of FIG. 2*c* using the invention. In this subsystem, in addition to the elements already present in FIG. 1, namely the comparator 16, the control means 12, the system 10 and the sensor 14, a transfer function has been added to each of the two inputs 50 and 51 of the comparator 16, said transfer function being respectively 52 and 53 and allowing the comparator 16 to operate on the curve 41, thus eliminating the effects of the offset and not on the curve 40 as in the prior art.

A variant of a method according to the invention consists in taking the two measurements during one and the same cycle. In this variant, the two measurements may or may not overlap. The overlap will occur in a mandatory fashion in combination with the variant described with the aid of FIG. 2*c* since the measurement 33 already occupies the whole cycle. The measurement 34 is taken during the second half of the same cycle. Taking both measurements during one and the same cycle makes it possible to limit the effects of an offset that might evolve over time.

The invention claimed is:

1. A method for commanding a system controlled by means of a time-division multi-level command, the method using a device receiving a setpoint and comprising a control subsystem in which a sensor measures a characteristic variable of the system which changes as a function of the setpoint, the measurement of the variable being capable of modifying the command of the system through the control subsystem, the method comprising the following operations:

acquiring two measurements by means of the sensor, each measurement having a duration extending over a period, the two periods being dissymmetrical relative to the division of the command, determining an offset of the control subsystem and a corrected response without offset of the system to the command as a function of the measurements and of the measurement periods.

2. The command method as claimed in claim 1, wherein the measured offset is calculated and subtracted from the measurements acquired by the control sensor by a system of two equations with two unknowns, the two unknowns being the corrected response without offset of the system and the offset of the measurement subsystem, the two equations being the measurements expressed as a function of the two unknowns.

3. The command method as claimed in claim 1, wherein the setpoint is a function of the offset.

4. The command method as claimed in claim 1, wherein the command is cyclical and in that, inside a cycle, there follows an active phase during which the system is commanded to a maximum level and an inactive phase during which the system is commanded to a minimum level.

5. The command method as claimed in claim 4, the period of the first measurement extends over the duration of the active phase and in that the period of the second measurement extends over the period of the inactive phase.

6. The command method as claimed in claim 4, wherein the measurement periods extend over at least one half-cycle.

7. The command method as claimed in claim 6, wherein the period of the first measurement extends over a complete cycle and in that the second measurement extends over a final half-cycle.

8. The command method as claimed in claim 6, wherein the period of the first measurement extends over an initial half-cycle and in that the second measurement extends over a final half-cycle.

9. The command method as claimed in claim 4, wherein the two measurements take place during one and the same cycle.

* * * * *